United States Patent [19]

Spencer

[11] Patent Number: 4,572,423

[45] Date of Patent: Feb. 25, 1986

[54] TAKE-OUT BOX WITH CUP AND LID RETAINER

[76] Inventor: Aaron Spencer, 69 Farlow Rd., Newton, Mass. 02159

[21] Appl. No.: 638,978

[22] Filed: Aug. 8, 1984

[51] Int. Cl.[4] ..... B65D 5/44; B65D 5/50

[52] U.S. Cl. ..... 229/28 R; 206/45.31; 206/45.14; 206/509; 229/33; 229/36; 229/DIG. 12

[58] Field of Search ..... 206/45.31, 45.14, 509; 229/28 R, 6 A, DIG. 12, 33, 36; 220/366

[56] References Cited

U.S. PATENT DOCUMENTS 2,924,372 2/1960 Kirkeby ..... 229/28 R 3,051,303 8/1962 Daanen et al. ..... 206/45.31

3,163,344 12/1964 Tunick ..... 229/DIG. 11

4,163,494 8/1979 Stollberg ..... 229/6 A 4,206,845 6/1980 Christian ..... 220/366

*Primary Examiner*—William T. Dixson, Jr.

*Attorney, Agent, or Firm*—Wolf, Greenfield & Sacks

[57] ABSTRACT

A generally rectangular take-out box for fast food establishments, having top, bottom and side walls. The top wall is hingedly connected to a side wall and has an opening at one end. The opening in the top wall is dimensioned so as to receive and secure the lid on a container bowl which is positioned beneath the opening, thus preventing both spillage from the container and slippage of the container within the box.

6 Claims, 8 Drawing Figures h
P
S

TAKE-OUT BOX WITH CUP AND LID RETAINER

BACKGROUND OF THE INVENTION

Soup or salad together with a sandwich or with other foods such as pizza is very popular luncheon fare in America and is frequently sold as part of take-out meals from all types of restaurants. The fast food industry, particularly, continuously seeks improved boxes and other containers for carrying out soup, salad, beverage, pizza, and other foods to enhance the sales of the prepared foods offered at their establishments.

Serving trays and boxes for carrying prepared foods away from fast food restaurants and other food vendors are, of course, old in the art. The trays used for that purpose typically contain cavities which are sized so as to receive various shaped containers such as cups, dishes and bags. The cavities are intended to prevent lateral shifting of the containers placed in them. None of the prior art boxes and trays, however, provide room for a soup, or salad beverage container along with other foods which are capable of retaining a cover on the container and preventing the container from toppling over or sliding so as to ensure that the liquid or other contents does not spill while the box or tray is being transported.

The principal object of the present invention to provide an improved take-out box which overcomes the limitations of the prior art boxes and trays.

More specifically, an important object of the present invention is to provide a take-out box which includes means for locking an inner container for soup, salad or beverage in a closed and stationary position so that the inner container cannot accidentally open and spill its contents over other food in the box or on the person or vehicle carrying the box.

Another important object of the present invention is to provide a food take-out box which may be stacked with other like take-out boxes.

Another object of the invention is to provide a take-out box having means for locking an inner liquid container closed and in a stationary position and for enabling steam generated by the liquid in the container to escape from the box.

Another object of the present invention is to provide an attractive food take-out box which enables the consumer to view at least a portion of the contents that is contained in its own package within the box.

SUMMARY OF THE INVENTION

The take-out box of the present invention comprises a tray and cover which together define top, bottom, front, rear and side walls. The cover in the preferred form of the invention is integrally formed with and hinged to the tray, and typically the box may be made of corrugated cardboard that may be die cut and creased in a single operation. The box in its preferred form is large enough to receive a small pizza or sandwich as well as a soup or salad bowl and lid. In the preferred form an opening is provided in the cover of the box which conforms to the shape of the upper portion of the lid, and the total inside height of the box is such that when the bowl and lid are placed in the box and the cover is closed, the lid extends into the opening and is held firmly on the bowl so that the bowl cannot be accidentally uncovered and cannot slide in the box and spill its contents on the other food in the box or mutilate that food by hitting against it. By using a transparent or translucent lid, the contents of the bowl may be viewed without opening the box cover. While in the preferred form the opening in the box registers with the lid so as to hold the soup or salad bowl and lid in the closed and stationary position, it is also to be understood that an opening may be provided in the tray of the box to receive the bottom of the bowl so as to accomplish the same purpose. In order to prevent the covered bowl from sliding in the box, the opening in the cover or tray of the box should precisely conform to the shape and size of the portion of the lid or bowl which it engages. With the opening in the cover, a portion of the lid is exposed and a venting slit or other port in the cover will be free to pass steam from the liquid to the atomsphere.

DESCRIPTION OF THE DRAWINGS

The foregoing and the other objects and advantages of the invention will be understood more fully from the following detailed description thereof, with reference to the accompanying drawings wherein.

DETAILED DESCRIPTION

Figures 4, 5, 6:
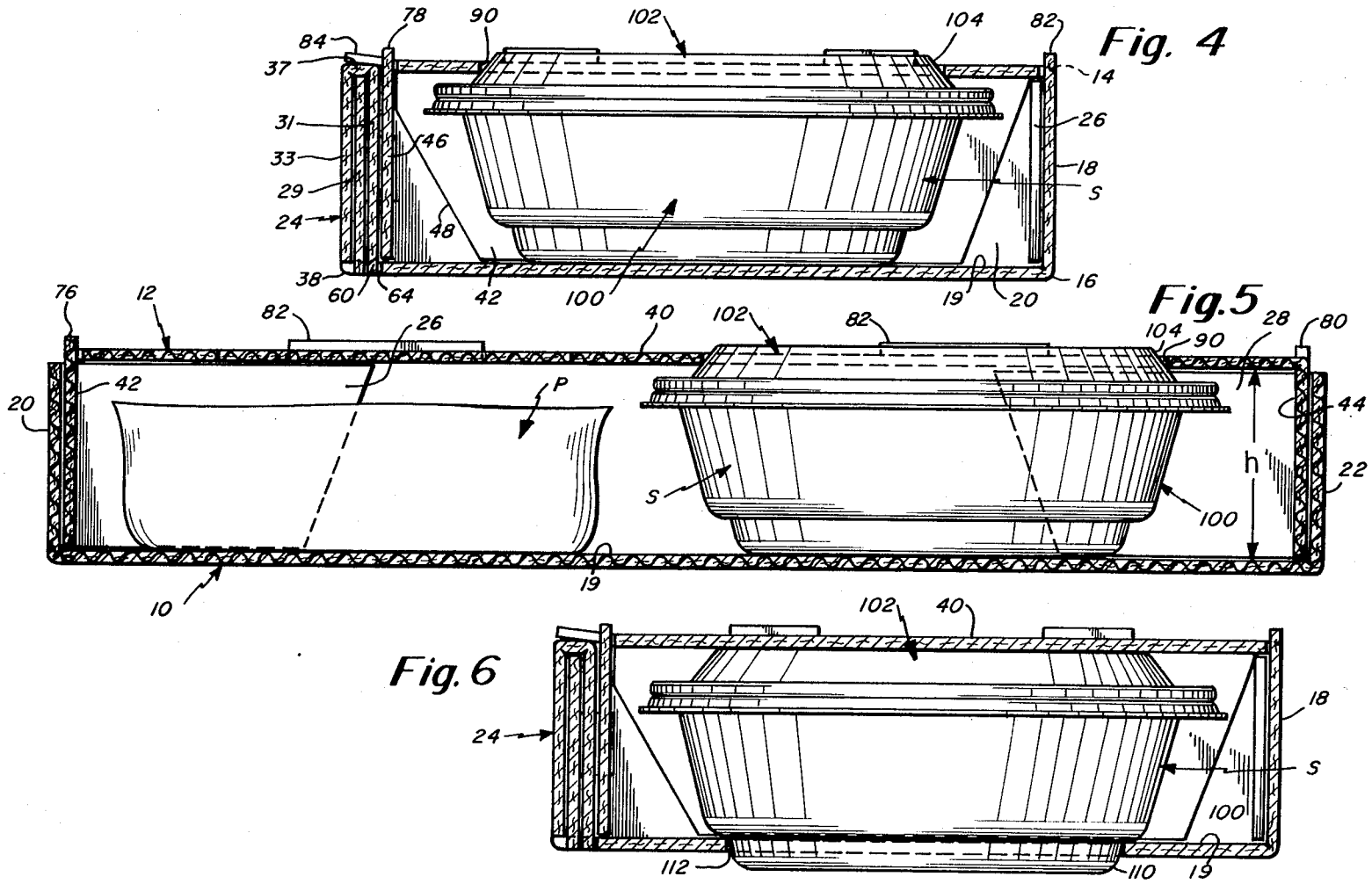
FIG. 4 is a cross sectional view of the box shown in FIG. 1 and showing the soup bowl and lid locked in position.
FIG. 5 is a cross sectional view of the closed box shown in FIG. 1 and showing the manner in which the box holds both a covered bowl and a small pizza.
FIG. 6 is a cross-sectional view similar to FIG. 4 but showing a second embodiment of this invention.

The take-out box shown in the drawings includes a tray 10 and cover 12 integrally formed from a single corrugated cardboard blank with the cover 12 hinged to the tray along fold lines 14 and 16 which respectively form the juncture of the cover and tray with the rear wall 18. The box typically may be made of corrugated cardboard but also may be made of any other material having sufficient strength and stiffness to perform the intended functions of the box. In one embodiment of the invention the closed box has overall dimensions of $6'' \times 12'' \times 2''$. As suggested in FIG. 5, the box is particularly designed to hold a covered bowl S and pizza pie P with sufficient clearance so that the two do not hit up against one another. It will, of course, be understood that the box can be of virtually any size and can be shaped to hold a variety of different foods in addition to or in place of the covered bowl and pizza suggested. The box is, however, principally intended to house an inner container for foods such as soup or salad and maintains the container both closed and stationary in the box.

Figure 1:
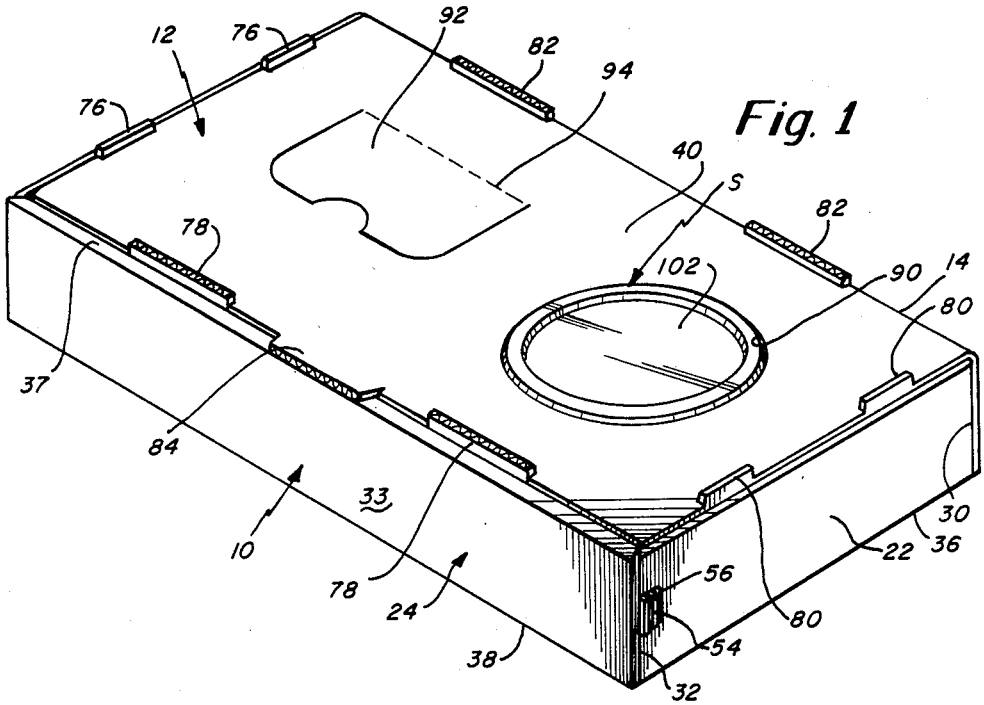
FIG. 1 is a perspective view of a take out box constructed in accordance with this invention and carrying a closed soup or salad bowl.
Figure 2:
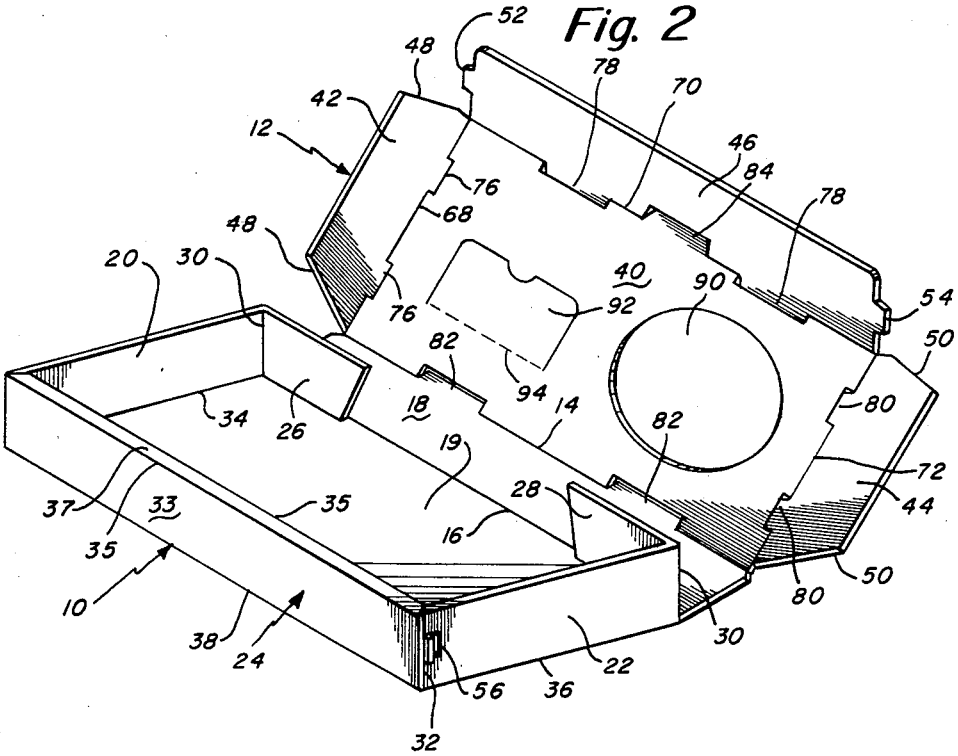
FIG. 2 is a perspective view of the box shown in FIG. 1 but with its cover in the open position and with the bowl removed.
Figure 3:
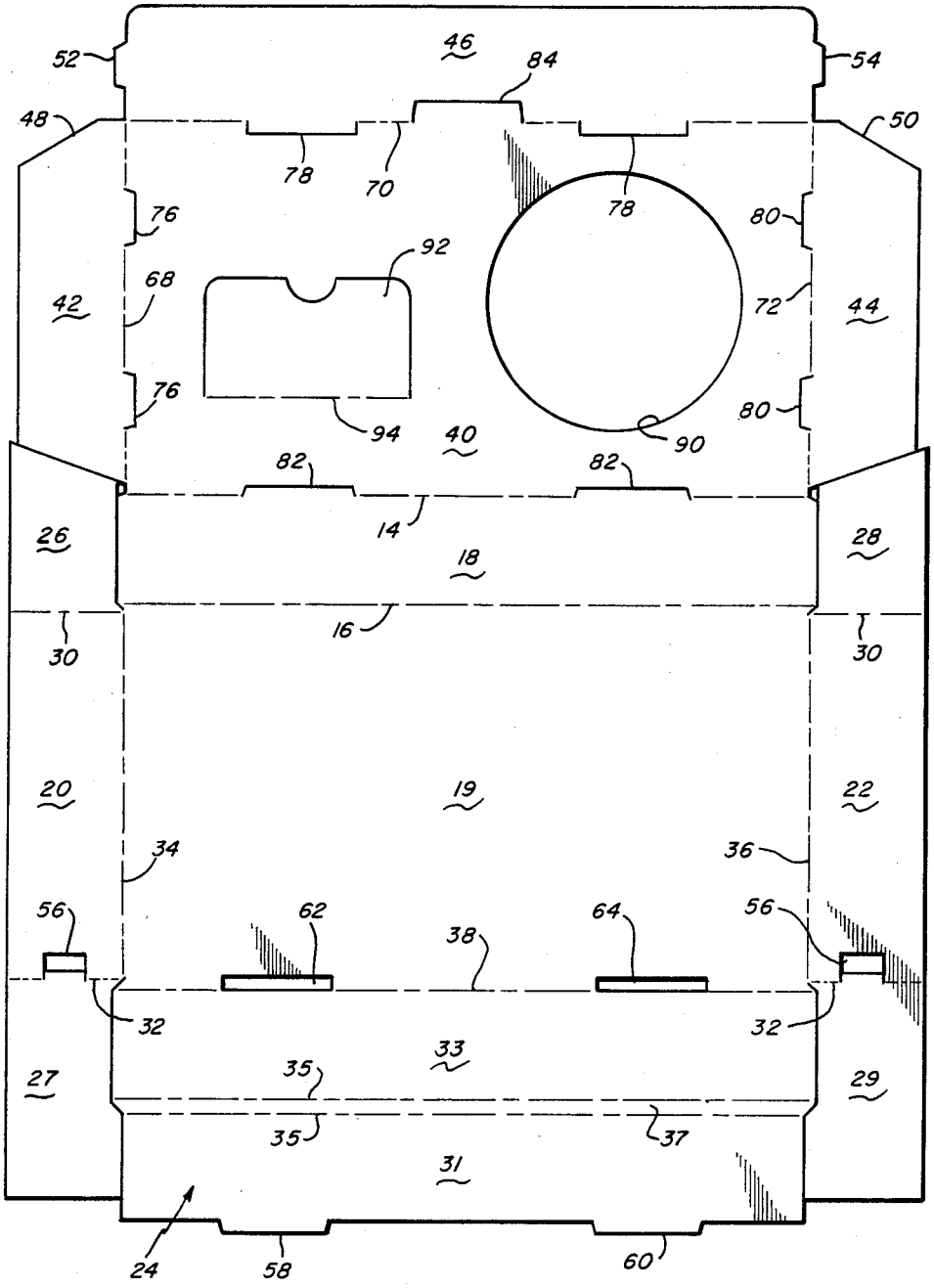
FIG. 3 is a plan view of a box blank from which the box shown in FIG. 1 is erected.

In FIGS. 2 and 3 the tray 10 of the box is shown to include bottom wall 19, side walls 20 and 22, front wall 24, and flanges 26 and 28 that overlap the rear wall 18 and flanges 27 and 29 that stand within the front wall 24 when the box is closed. The flanges 26 and 28 are connected to the box blank along the fold lines 30 and the flanges 27 and 29 are connected at fold lines 32, while the side walls 20 and 22 are connected to the bottom wall 19 of box blank by fold lines 34 and 36. Front wall 24 which is described more fully below is connected to bottom wall 19 at fold line 38.

The box cover 12 includes a top wall 40, side flaps 42 and 44 and front flap 46. The flaps 42, 44 and 46 are designed to fit inside the side walls 20 and 22 and the front wall 24 of the tray when the box is closed. The side edges 48 and 50 of flaps 42 and 44, respectively are tapered so as to facilitate insertion of those flaps into the tray of the box when the cover 12 is closed. The front flap 46 is formed with a pair of locking ears 52 and 54 on its side edges which are sized and positioned so as to register with openings 56 at the front edges of the side walls 20 and 22 of the tray.

To erect the box from the blank shown in FIG. 3 the side walls 20 and 22 are folded perpendicular to the bottom wall 19 of the tray along scored fold lines 34 and 36, and the front wall 24 is folded up along its fold line 38. The front wall 24 has inner and outer panels 31 and 33 connected together at the double-scored fold line 35 which defines the upper edge 37 of the front wall when the box is erected. Outer panel 33 lies outside the flanges 27 and 29, and inner panel 31 is folded down on scored line 35 to lie behind or inside flanges 27 and 29, and the tabs 58 and 60 extend into the slots 62 and 64 cut in the bottom wall 19 along line 38. To close the box, rear wall 18 is folded up along line 16 so as to lie against the back of the flanges 26 and 28, and the flaps 42, 44 and 46 are slipped inside the walls 20, 22 and 24. As mentioned, the locking ears 52 and 54 on the flap 46 slide into the slots 56 so as to releasably lock the cover in place.

Figure 7:
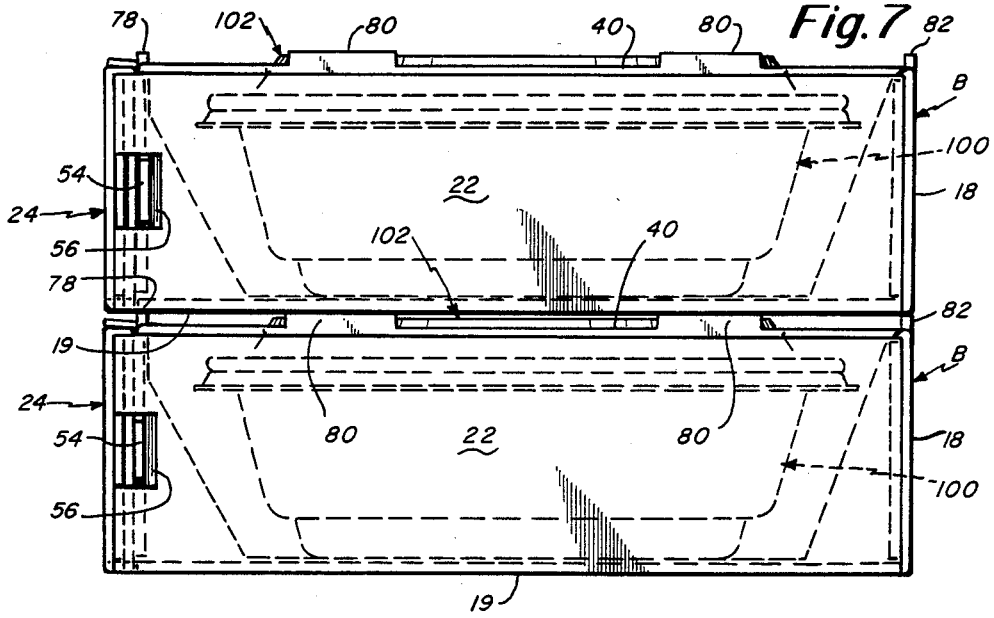
FIG. 7 is a side elevation view showing the manner in which a number of identical boxes constructed in accordance with this invention may be stacked together.

The cover 12 along fold lines 68, 70, 72 and 14 is formed with upstanding flanges 76, 78, 80 and 82 that extend above the top plane of the top wall 40 of the cover when the box is closed. The function of the flanges 76, 78, 80 and 82 is described below in connection with FIG. 7. A finger tab 84 is also formed along fold line 70, which extends over the upper edge 37 of front wall 24 when the cover is closed so as to facilitate opening of the box.

The top wall 40 of cover 12 has a circular opening 90 and a vent flap 92. The vent flap 92 is hinged along scored line 94 so that it may be elevated or depressed above or below the plane of the wall 40. The vent flap 92 performs the conventional function of allowing steam in the box to escape and is used when the box stores hot foods such as pizza, as it prevents steam from being trapped in the box and making the food soggy. The opening 90 in the cover, as suggested above, performs the locking function for the container S as described more fully below.

The container S includes a base or bowl 100 and lid 102. The bowl and lid are provided with mating rims that releasably engage one another to close the container. While the rims are intended to lock the lid in place on the bowl, obviously the two frequently accidently separate, and it is a principle object of this invention to provide a box which prevents that from occurring. The particular configuration of the soup container S does not form part of this invention. It is only necessary that the lid 102 of the container be domed-shaped or otherwise have an upwardly extending portion such as shown at 104 to register with and extend into the opening 90 when the cover 12 of the box is closed. The height h of the closed box with respect to the soup container S is selected so that the dome 104 of the lid extends into the opening 90 when the bowl 100 rests on the bottom wall 19 of the box. It will be noted in FIGS. 4 and 5 that with the cover 12 of the box closed, the dome 104 of lid 102 extends into and slightly above the opening 90 in the top wall 40, and the top wall 40 bears against the lid 102 and holds it firmly in place on the bowl 100. The best results may be achieved if the height h is slightly less than the vertical distance between the bottom of bowl 100 and the plane in the lid whose diameter matches that of opening 90 so as to achieve a press fit between the closed box and soup container. That relationship also serves to prevent the assembled bowl and lid from moving translationally in the box when the box is jarred or tilted. The lid 102 is held firmly in place and prevents the contents from spilling and also prevents the container S from sliding into and squashing the pizza P or other food stored in the box. It will be appreciated that because the dome 104 of the lid 102 is exposed through the opening 90, any steam venting slit or other opening provided in the lid is allowed to function normally even though the container S is almost fully enclosed. This is a particularly important advantage when the container S holds a hot soup or beverage. It will also be appreciated that in this arrangement, if the lid is transparent or translucent, the contents of the bowl may be viewed even when the box is closed.

While in the embodiment shown the opening 90 is formed in the top wall 40 of the box and is shaped to engage the container lid 102, it will be appreciated that the opening could be provided in the bottom wall 19 of the tray of the box and be sized and positioned so as to engage the lower portion of the bowl 100. In that arrangement, as suggested in FIG. 6, the base 110 of the bowl extends through the opening 112 in the bottom wall of the tray and the top wall 40 of the box bears against the top of the lid 102. In this arrangement, just as in the preferred embodiment, the tray and cover cooperate to hold the lid and bowl in assembled relationship and prevent the bowl and lid from sliding sideways in the box.

The vertical flanges 76, 78, 80 and 82 which extend upwardly above the top wall 40 serve as stacking means to support the bottom wall 19 of one box slightly above the surface of the top wall 40 of another box below when two or more boxes are stacked vertically one above another in the manner suggested in FIG. 8. In that figure it will be noted that the lower surface of the bottom wall 19 of the upper box B rests on the tops of the flanges 76, 78, 80 and 82 of lower box B when two such identical boxes are stacked one on top of the other. The space above the upper surface of the top wall of the lower box enables steam to escape from the lower box through the vent flap 92 and allows the boxes to stack without interferences from the protruding domes of the lids. As the overall plan dimensions of the bottom wall of the tray are greater than the top wall of the cover and the upper edges of the flanges 76, 78, 80 and 82 are flat, the upwardly extending flanges can provide a stable platform for the upper box and allow many boxes to be stacked one upon another. The flanges 76, 78, 80 and 82 will also allow boxes of the embodiment of FIG. 6 to be stacked without interference from the protruding base of the bowl.

Figure 8:
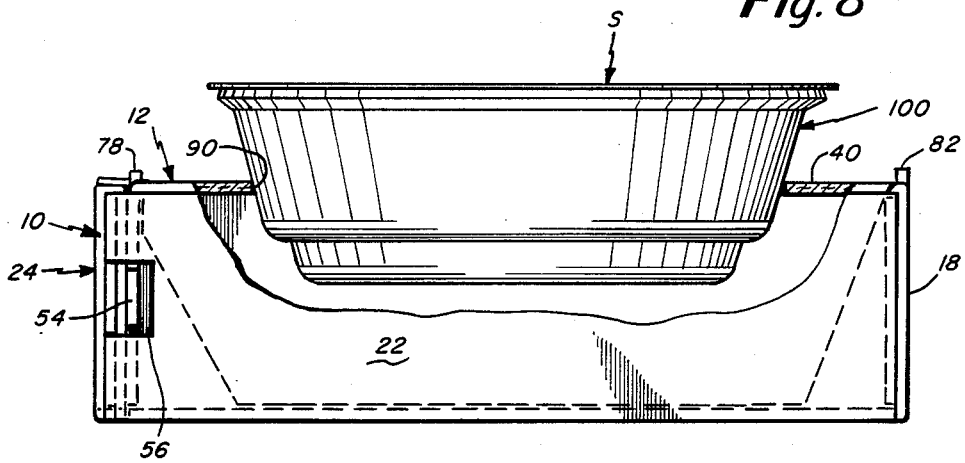
FIG. 8 is a side elevation view, partly in section, showing an alternative use and additional advantage which may be derived from the embodiment of FIGS. 1–5.

In FIG. 8, another use for the opening 90 in the top wall of the box cover 12 is suggested. In that figure the box is shown used as a small tray to support the bowl when its contents are being eaten. If the bowl is provided with a base dimensioned to fit within the opening 90, the opening will provide a stable platform for the bowl, and the bowl will not slide on the upper surface. The upper surface of the box is of course sufficiently large so as to support any other food also stored in the box.

From the foregoing, it will be appreciated that the box of this invention provides a convenient and effective package for use by restaurants of all kinds that sell prepared food to be eaten off the premises. The security of a tight, non-leaking container for salad, soup or other liquid will have substantial appeal for the customer and should stimulate sales of the establishment using boxes embodying this invention.

Having described this invention in detail, those skilled in the art will appreciate that numerous modifications may be made of this invention without departing from its spirit. Therefore, it is not intended that the breadth of this invention be limited to the specific embodiments illustrated and described. Rather, it is intended that the scope of this invention be determined by the appended claims and their equivalents.

What is claimed is:

1. A food take-out box having provisions for holding an inner container composed of a base and lid along with other food stuffs, the lid having an upwardly-extending portion, said box comprising:

a tray having a bottom wall and peripheral walls extending upwardly from the bottom wall, a cover integrally formed with the tray and hinged thereto through one of said peripheral walls, said cover having a top wall and peripheral flaps which fit within the peripheral walls of the tray when the cover is closed, and an opening in the top wall of the cover for engaging the upwardly-extending portion of the lid and holding it firmly on the base of the container and preventing the container from sliding in the box when the cover is closed.

2. A food take-out box according to claim 1, further comprising:

a vent flap formed in the top wall of the cover for allowing steam given off by other foods in the box to escape from the box when the cover is closed, and a plurality of stacking means formed as part of the cover for supporting the bottom of a second identical box above the first box with a space between the boxes, the space enabling steam to escape through the vent flap of the lower box and to provide clearance for the upwardly-extending portion of the lid protruding from the opening in the cover of the lower box.

3. A food take-out box having provisions for holding an inner container composed of a base and lid along with other food stuffs, the lid having an upwardly-extending portion, said box comprising:

a tray having a bottom wall and peripheral walls extending upwardly from the bottom wall, a cover integrally formed with the tray and hinged thereto through one of said peripheral walls, said cover having a top wall and peripheral flaps which fit within the peripheral walls of the tray when the cover is closed, means for temporarily locking the cover on the tray in a closed position, and an opening in the top wall of the cover for engaging the upwardly-extending portion when the cover is closed, the interior height of the closed box being slightly less than the vertical distance between the bottom of the container base and the plane in the lid whose diameter matches that of the opening to achieve a press fit between the closed box and the container which holds the lid firmly on the base and prevents the container from sliding in the box when the cover is closed.

4. A food take-out box according to claim 3, further comprising:

a vent flap formed in the top wall of the cover for allowing steam given off by other foods in the box to escape from the box when the cover is closed, and a plurality of stacking means formed as part of the cover for supporting the bottom of a second identical box above the first box with a space between the boxes, the space enabling steam to escape through the vent flap of the lower box and to provide clearance for the upwardly-extending portion of the lid protruding from the opening in the cover of the lower box.

5. A food take-out box according to claim 4, wherein:

said peripheral walls comprise side, front and rear walls, said cover is hinged to the tray through said rear wall and said peripheral flaps comprise front and side flaps, said temporary locking means comprises locking ears on the front and side flaps which register with corresponding openings in the tray, and said stacking means comprises a plurality of flanges lying in the planes of the front and side flaps and the rear wall when the box is closed for supporting the bottom wall of an identical box placed thereon.

6. A food take-out box having provisions for holding an inner container composed of a base and lid along with other food stuffs, said box comprising:

a tray having a bottom wall and peripheral walls extending upwardly from the bottom wall, a cover integrally formed with the tray and hinged thereto through one of said peripheral walls, said cover having a top wall and peripheral flaps which fit within the peripheral walls of the tray when the cover is closed, means for temporarily locking the cover on the tray in a closed position, and an opening in the bottom wall of the tray for engaging the base, the interior height of the closed box being slightly less than the vertical distance between the plane in the base whose diameter matches that of the opening and the top of the lid to achieve a press fit between the closed box and the container which holds the lid firmly on the base and prevents the container from sliding in the box when the cover is closed.

* * * * *